US011279517B2

(12) United States Patent
Ritzberger

(10) Patent No.: US 11,279,517 B2
(45) Date of Patent: Mar. 22, 2022

(54) STACK CONTAINER

(71) Applicant: Georg Utz Holding AG, Bremgarten (CH)

(72) Inventor: Axel Ritzberger, Altendorf (CH)

(73) Assignee: Georg Utz Holding AG, Bremgarten (CH)

( * ) Notice: Subject to any disclaimer, the term of this patent is extended or adjusted under 35 U.S.C. 154(b) by 592 days.

(21) Appl. No.: 15/741,336

(22) PCT Filed: Jun. 29, 2016

(86) PCT No.: PCT/EP2016/065120
§ 371 (c)(1),
(2) Date: Jan. 2, 2018

(87) PCT Pub. No.: WO2017/005571
PCT Pub. Date: Jan. 12, 2017

(65) Prior Publication Data

US 2018/0186512 A1 Jul. 5, 2018

(30) Foreign Application Priority Data

Jul. 3, 2015 (DE) ..... 10 2015 110 789.9

(51) Int. Cl.
*B65D 21/02* (2006.01)

(52) U.S. Cl.
CPC ..... *B65D 21/0213* (2013.01)

(58) Field of Classification Search
CPC ..... B65D 21/0213; B65D 21/0209
See application file for complete search history.

(56) References Cited

U.S. PATENT DOCUMENTS

2003/0024844 A1* 2/2003 Hammett ..... B65D 1/22 206/505
2008/0142530 A1* 6/2008 Meers ..... B65D 11/184 220/666

FOREIGN PATENT DOCUMENTS

DE 78 07 870 U1 7/1978
DE 41 37 941 A1 8/1992
(Continued)

OTHER PUBLICATIONS

International Search Report of PCT/EP2016/065120, dated Sep. 26, 2016.

*Primary Examiner* — Don M Anderson
(74) *Attorney, Agent, or Firm* — Collard & Roe, P.C.

(57) ABSTRACT

The invention relates to a stack container for transporting and storing objects, said container consisting of a rectangular base with side walls rising vertically from the bottom edges, with the top edge of the side walls being designed to be cantilevered outwards as a support surface for the rim of a second identically constructed container which is also cantilevered outwards and surrounds the base, said container being characterized in that the upper side of the top edge of the side walls and the underside of the rim surrounding the base are formed complementary to one another in such a way that, over the extension of the container circumference, partial surfaces of the top edge and the rim are designed differently in their angle of inclination, such that the corner areas of both the top edge and the rim surrounding the base are formed horizontally between two adjacent side walls each, whereas between the corner areas the top edge and the rim are designed at least in parts such that they are obliquely inclined outward and downward at an angle from the level of the horizontal corner area.

5 Claims, 4 Drawing Sheets

(56) References Cited

FOREIGN PATENT DOCUMENTS

Figure 1:
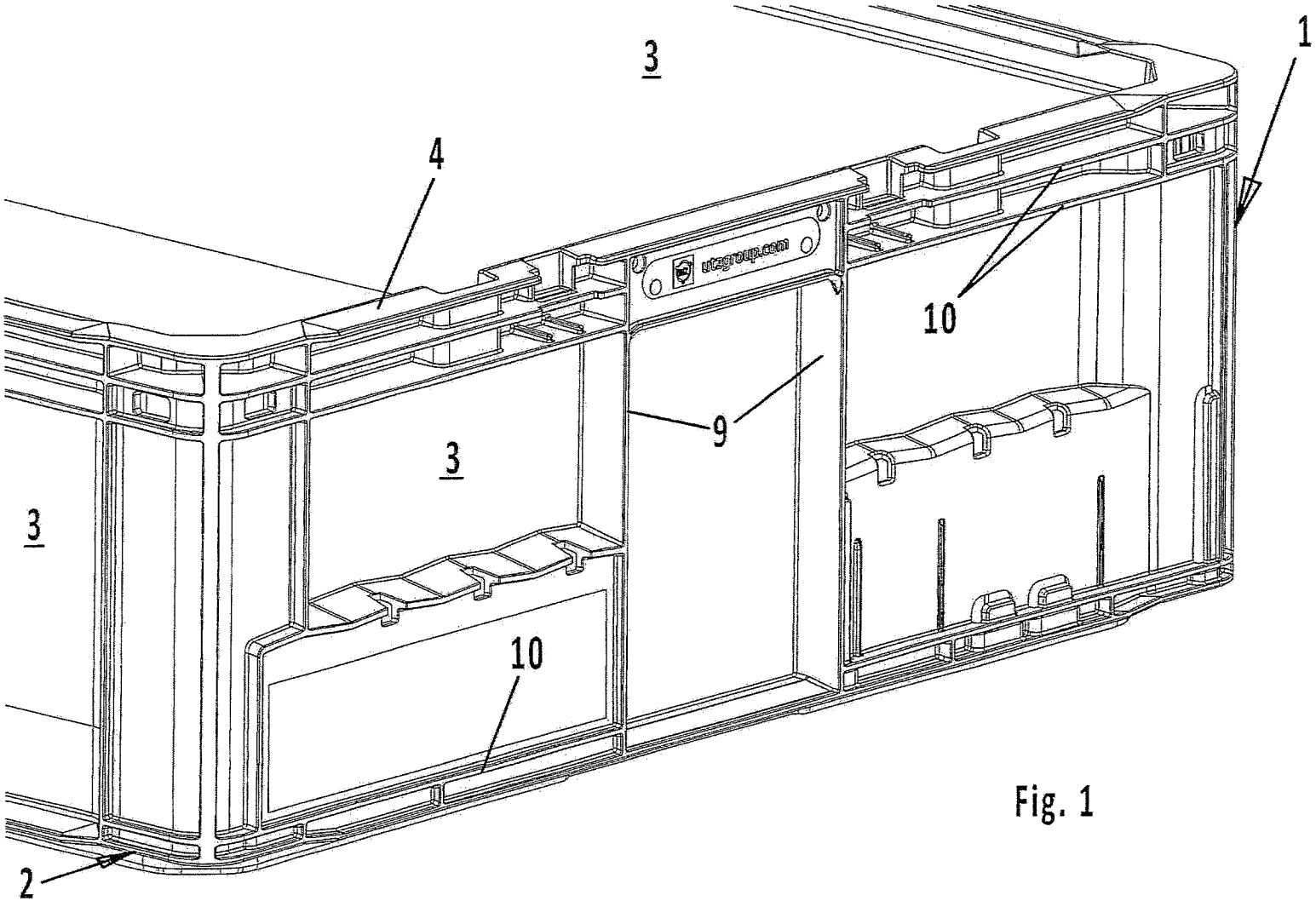

| | | | |
|---|---|---|---|
| EP | 2 664 556 | A1 | 11/2013 |
| GB | 2 252 294 | A | 8/1992 |

* cited by examiner

STACK CONTAINER

CROSS REFERENCE TO RELATED APPLICATIONS

This application is the National Stage of PCT/EP2016/065120 filed on Jun. 29, 2016, which claims priority under 35 U.S.C. § 119 of German Application No. 10 2015 110 789.9 filed on Jul. 3, 2015, the disclosure of which is incorporated by reference. The international application under PCT article 21(2) was not published in English.

The invention relates to a stack container for the transportation and storage of objects, said container consisting of a rectangular base with side walls rising vertically from the base rims, with the top edge of the side walls cantilevering outwards as a supporting surface for the rim of a second identical container which surrounds the base and is also projecting outwards.

Stack containers of this type are known per se. These prior-art containers provide for the interacting supporting surfaces, on the one hand the top edge of the side walls and, on the other, the bottom edge surrounding the base, to be arranged horizontally, i.e. protruding at right angles from the side wall. However, such a design has the disadvantage that, for example, rainwater may accumulate between the containers stacked one on top of the other and is then allowed to ingress into the container arranged below.

Furthermore, also the cleaning of such containers is not easy.

What is more, the stackability is also impaired insofar as dirt particles or similar substances may collect on the horizontally running flange-like edges, so that a full-surface contact of the containers on top of each other cannot be guaranteed.

It is therefore the objective of the present invention to provide a stack container of the kind first mentioned above designed in such a manner that these drawbacks are diminished.

The invention solves this task in that the upper side of the top edge of the side walls and the lower side of the rim surrounding the base are formed complementary to each other, in such a way that over the extension of the circumference of the container, partial surfaces of the top edge and the rim are designed with a different inclination angle in such a way that the corner areas of both the top edge and the rim surrounding the base are formed horizontally between two adjacent side walls each, whereas between the corner areas the top edge and the rim are designed at least in parts such that they are obliquely inclined outward and downward at an angle from the level of the horizontal corner area.

Thus, the horizontal corner areas are the areas that absorb the imposed load of the container or containers stacked on top of each other. The obliquely inclined areas arranged in between and distributed around the circumference of the container allow rainwater or wash water to drain outwards and down as in the case of a house roof, so that there is no danger of this water penetrating into the containers. A further advantage of these inclined areas is that dirt and foreign matter have less grip on the inclined surface and these surfaces are therefore easier to keep clean.

As an additional advantage of the container design, the different inclination distribution around the circumference of the container results in providing certain form-closing properties and a self-centering effect when two similar containers are placed on top of each other.

Pursuant to a further embodiment, it is proposed that the transitional area between the horizontal corner areas and the inclined partial sections shall, in vertical projection from above, be formed in a triangular, obliquely extending pattern. This means that the horizontal corner area does not abruptly merge into the sloping edge area, but that they harmoniously merge with one another which results in improvements in terms of cleaning and handling.

Although the edge areas inclined obliquely outwards and downwards from the container side wall to the outside can be designed at an angle throughout, it is intended as an alternative in accordance with another embodiment that the outwardly inclined partial sections in their outer edge area will merge into a narrow horizontal strip. This narrow edge strip contributes to the stability of the container construction.

Pursuant to a further embodiment, it is proposed that the top edge of the side walls is to be designed in the form of a flange over the entire surface so that impinging water or contaminations can drain off on these surfaces. On the other hand, the complementary support in the bottom area does not necessarily have to be of full-faced design, especially not in the area of the corners, which results in material savings.

In order to strengthen the container, claim 5 provides for the side walls to be reinforced on their outside by horizontal and vertical ribs underneath the outwardly projecting top edge, wherein these ribs may also be present in the area of the bottom edge.

The stack containers proposed by the present invention are advantageously manufactured from plastic by injection molding according to claim 6.

Figure 2:
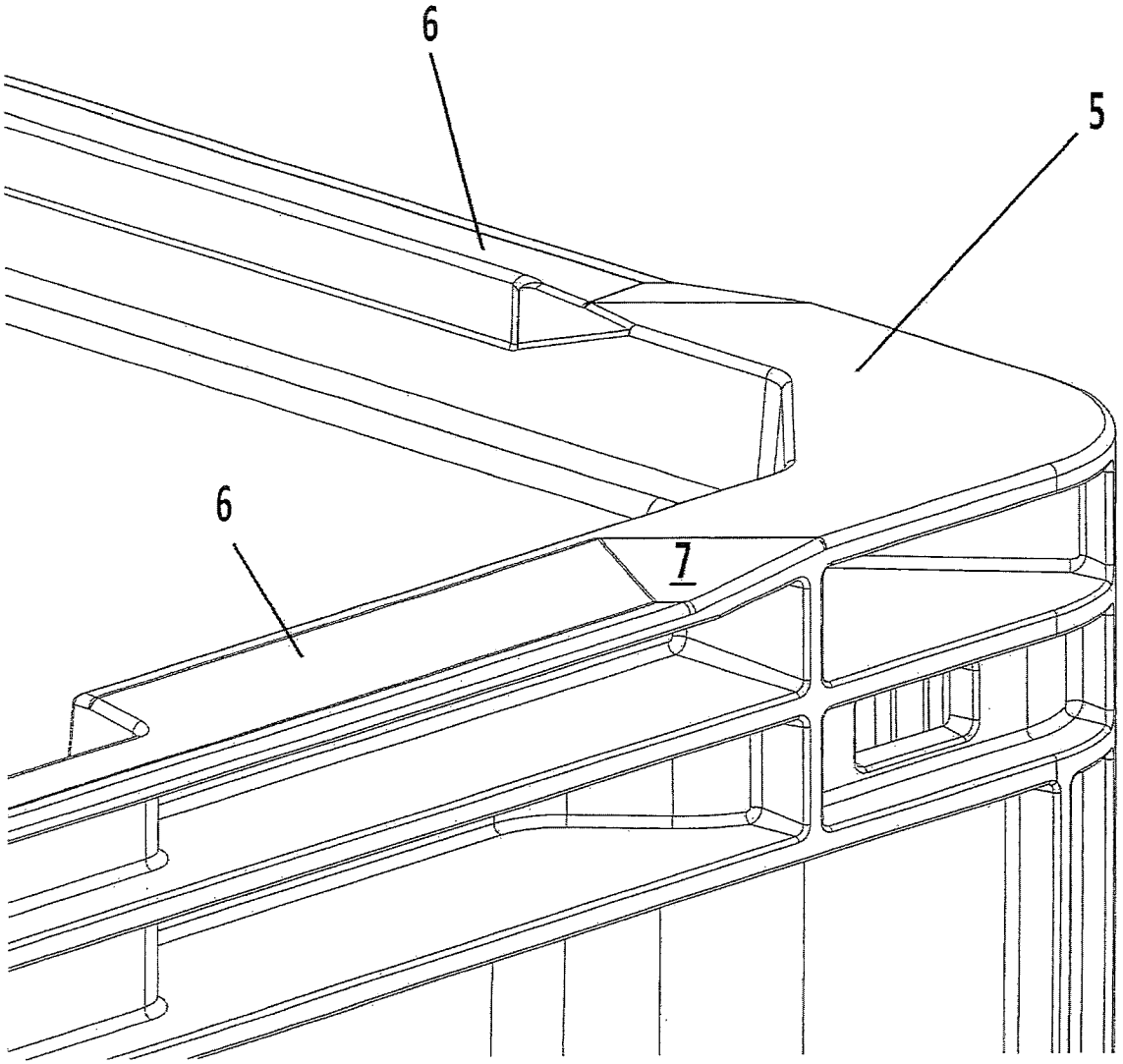
Figure 3:
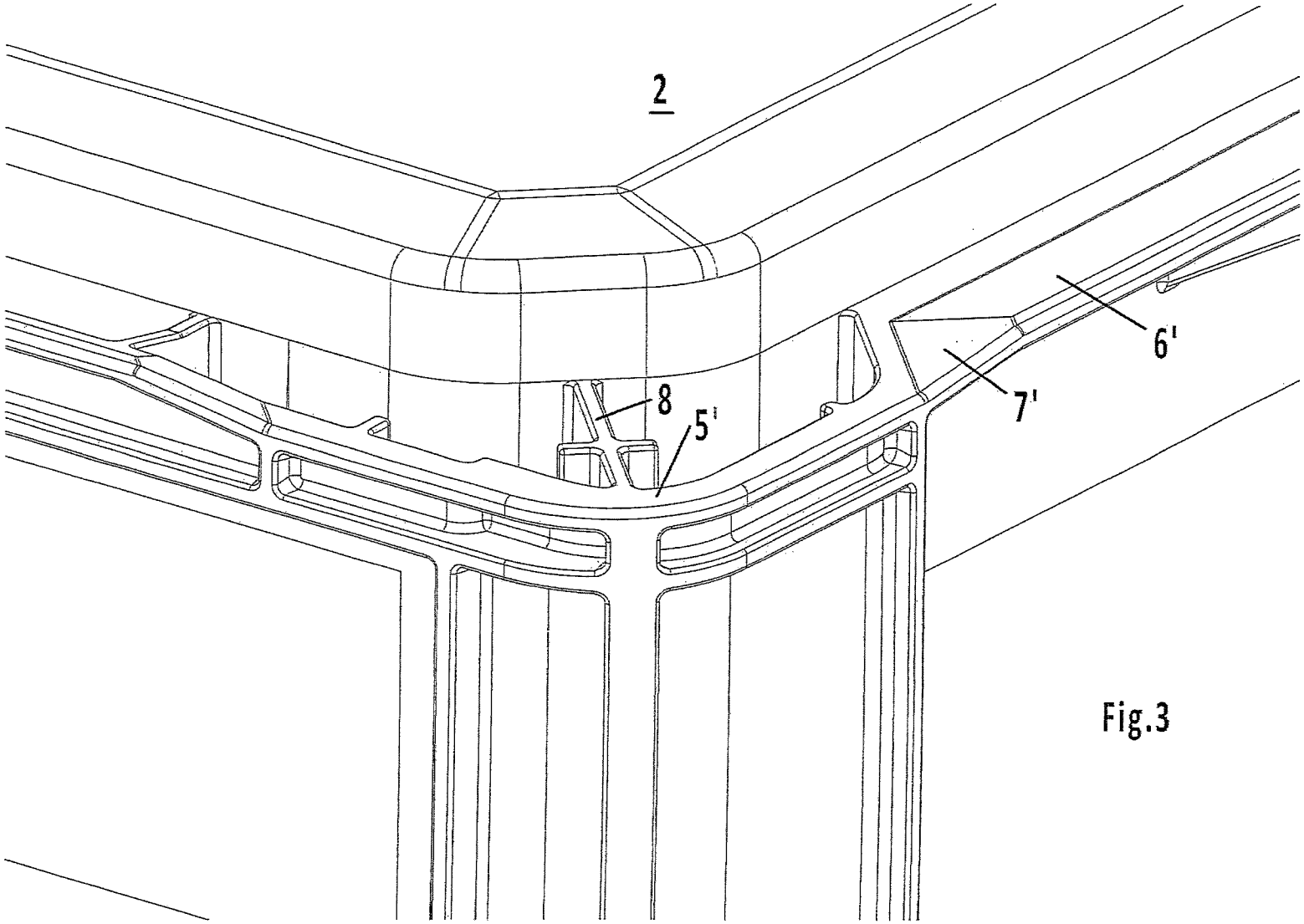
Figure 4:
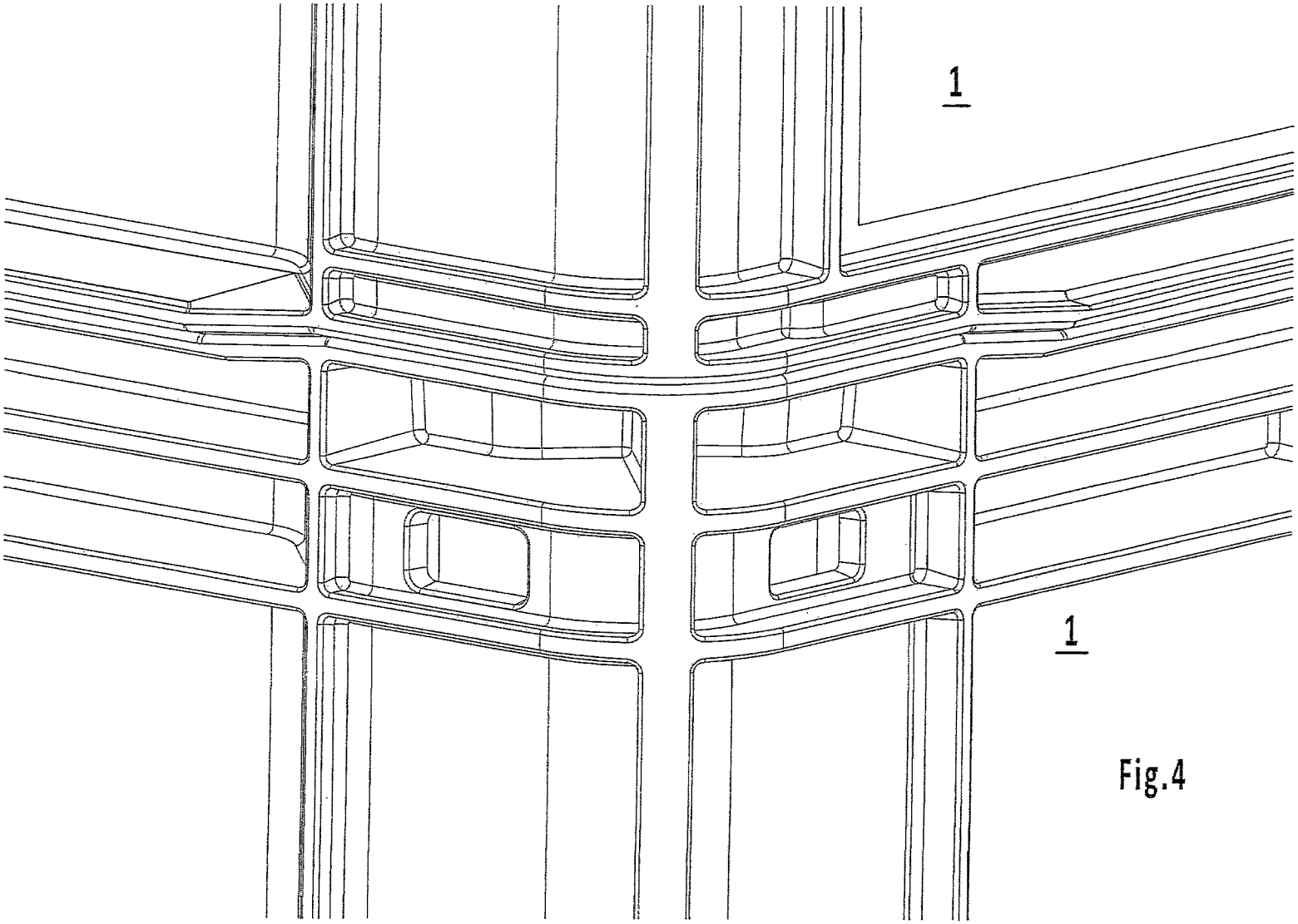

The present invention is elucidated in sufficient detail and depicted by way of the following figures, where FIG. 1: shows a section of a stack container as a perspective representation;

FIG. 2: illustrates the upper corner area of a container shown in FIG. 1;

FIG. 3: shows the bottom corner area of a container as per FIG. 1;

FIG. 4: is a partial view of two containers stacked on top of each other according to FIG. 1.

FIG. 1 shows a stack container for which the reference numeral 1 is used in general. It consists of a base 2 and side walls 3 extending upwards from the base 2. The side walls 3 have a top edge 4, which is provided with its outwardly cantilevering support surface for a container 1 which is identical in construction and placed on top of container 1.

As is clearly illustrated in FIG. 2, the top edge in the corner area between two adjacent side walls 3 is designed as a horizontal surface 5. The edge areas adjoining the horizontal support surface 5 to the respective sides have an inclined outward and downward slope and are provided with the reference numeral 6.

The transition between the horizontal support surface 5 and the obliquely inclined partial surface 6 is formed by an obliquely inclined, approximately triangular surface 7 in both circumferential direction and perpendicular to it.

As can be seen from FIG. 3, in which the container is shown rotated by 180°, the extensions of the corner area and the adjoining lateral edge areas are designed complementary to the top edge, although the corner area 5' is not designed here as a full-surface area but is open towards the bottom, with a web-like rib 8 being provided to reinforce this area. The areas complementary to the top edge are marked here with reference numerals 6', 7'.

In FIG. 4 a situation is illustrated in which two identical containers 1 are placed on top of each other, with the complementary extension of the top edge of the lower container 1 and the bottom edge of the upper container 1 being exactly matched to each other.

As is particularly evident from FIG. 1, the side walls 3 are reinforced by vertical ribs 9 and horizontal ribs 10.

The invention claimed is:

1. A stack container for transporting and storing objects, said container comprising:

(a) a rectangular base having bottom edges;

(b) side walls rising vertically from the bottom edges and forming a top edge cantilevered outwards to form a support surface; and (c) a rim surrounding the base and having an underside formed complementary to an upper side of the edge of the side walls, the rim being cantilevered outwards;

wherein partial surfaces of the top edge and the rim have different angles of inclination, such that corner areas of the top edge and corner areas of the rim surrounding the base are formed horizontally and intermediate areas between the corner areas have inclined partial sections obliquely inclined outward and downward at an angle from the horizontal corner area, and wherein the inclined partial sections merge into a horizontal configuration in outer edge areas of the partial sections.

2. The stack container according to claim 1, wherein a transitional area between the horizontal corner areas and the inclined partial sections (6, 6'), in vertical projection from above, is formed in a triangular, obliquely extending pattern.

3. The stack container according to claim 1, wherein the top edge of the side walls forms a flange.

4. The stack container according to claim 1, wherein the side walls are reinforced on outer sides of the side walls by horizontal and vertical ribs arranged below the outwardly projecting top edge.

5. The stack container according to claim 1, wherein the container is made of plastic material by injection molding.

* * * * *